US005865545A

United States Patent [19]

Kondo

[11] Patent Number: 5,865,545

[45] Date of Patent: Feb. 2, 1999

[54] INK RIBBON CARTRIDGE FOR PRINTER

[75] Inventor: Shinichi Kondo, Miyaga, Japan

[73] Assignee: Sony Corporation, Japan

[21] Appl. No.: 881,466

[22] Filed: Jun. 24, 1997

[30] Foreign Application Priority Data

Jul. 2, 1996 [JP] Japan ..... 8-172488

[51] Int. Cl.[6] ..... B41J 35/28

[52] U.S. Cl. ..... 400/207; 400/208

[58] Field of Search ..... 400/207, 208, 400/208.1

[56] References Cited

U.S. PATENT DOCUMENTS

| | | | |
|---|---|---|---|
| 5,352,049 | 10/1994 | Shiraishi et al. | 400/246 |
| 5,455,617 | 10/1995 | Stepheson et al. | 400/207 |
| 5,492,422 | 2/1996 | Kondo | 400/208.1 |
| 5,547,298 | 8/1996 | Wouters et al. | 400/207 |
| 5,695,292 | 12/1997 | Coote | 400/208.1 |

FOREIGN PATENT DOCUMENTS

| | | | |
|---|---|---|---|
| 0213181 | 9/1986 | Japan | 400/208 |
| 0 475 404 | 2/1992 | United Kingdom . | |
| 0 475 404 | 3/1992 | United Kingdom . | |
| 0 679 524 | 11/1995 | United Kingdom . | |
| 95/20490 | 8/1995 | WIPO . | |

*Primary Examiner*—Edgar Burr
*Assistant Examiner*—Anthony H. Nguyen
*Attorney, Agent, or Firm*—Ronald P. Kananen

[57] ABSTRACT

An ink ribbon cartridge for a printer according to the present invention is one in which drive side shaft portions and driven side shaft portions of a ribbon supplying spool shaft wound up with an unused ribbon and a ribbon take-up spool shaft for winding a used ribbon are rotatably received respectively by drive side bearing means and driven side bearing means of a housing formed of only a lower shell. The drive side bearing means have U-letter shaped drive side bearing portions having shaft disengagement stopping portions at opening portions into which the drive side shaft portions are inserted from the top, flange receiving portions at the outside of the bearing portions on the same plane for receiving flanges of the drive side shaft portions, and slits formed with upper portions cut off and between the drive side bearing portions and the flange receiving portions making the drive side bearing portions capable of being elastically deformed toward the slits. The driven side bearing means form U-letter shaped driven side bearing portions having shaft disengagement stopping portions at opening portions into which the driven side shaft portions are inserted from the top, and spool pushing springs located at the back of the driven side shaft receiving portions.

9 Claims, 5 Drawing Sheets

INK RIBBON CARTRIDGE FOR PRINTER

BACKGROUND OF THE INVENTION

1. Field of the Invention

The present invention relates to an ink ribbon cartridge used for a printing apparatus for printing a recorded picture such as a video image or the like as a hard copy, a so-called color photograph or the like and which housed in is a spool shaft with an ink ribbon wound therearound.

2. Description of the Related Art

A conventional ink ribbon cartridge will be described with reference to FIG. 1 and FIG. 2.

FIG. 1 is a perspective view under a state where the ink ribbon cartridge is disassembled, and FIG. 2 is a perspective view under a state where the ink ribbon cartridge is assembled.

As shown in FIGS. 1 and 2, the ink ribbon cartridge consists of a lower shell 40, an upper shell 41 and an ink ribbon unit 1.

Firstly, a construction of the lower shell 40 will be described. The lower shell 40 has a pair of semicircular spool shaft receiving units 42, 43 and both the end portions of both the spool shaft receiving portions 42, 43 are integrally connected with wall plates 44, 45, respectively. One wall plate 44 is provided with bearing apertures 46, 47 in which are pivotally received drive side shaft portions of both spool shafts of the ink ribbon unit 1, which will be described later on, and the other wall plate 45 is provided with U-letter shaped bearing portions 48, 49 corresponding to the bearing apertures 46, 47, respectively by which driven side shaft portions of both the spool shafts are pivotally received. A portion between both the above-mentioned spool shaft receiving portions 42, 43 is made as an opening portion 50. Besides, ribs 51, 51 are formed on outer side edge portions of both the spool shaft receiving portions 42, 43, respectively.

On the other hand, the upper shell 41 has an opening portion 52 the same size as the opening 50 in the lower shell 40 through its upper surface, and constitutes a housing of the ink ribbon cartridge after being combined with the lower shell 40. In addition, the upper shell 41 has also ribs 53, 53 formed on its outer side surface portions.

On the other hand, the ink ribbon unit 1 is constructed as follows. There are provided a ribbon supply spool shaft 2 wound up with an unused ink ribbon 3 and a number 4 is a ribbon takeup spool shaft 4 for winding a used ink ribbon. At one end portions of both the spool shafts 2, 4 there are respectively provided hollow drive side shaft portions 5, 6 by way of flanges 5*a*, 6*a*. On internal circumferential surfaces of the drive side shaft portions 5, 6 are respectively formed projections not shown in the figure which will engage with drive shafts of the printer.

Further, at the other ends of both the spool shafts 2, 4 there are respectively provided driven side shaft portions 7, 8. Further, a ribbon code reading ring 9 is rotatably supported by a shaft portion between the ribbon supply spool 2 and the driven side shaft portion 7.

In order to assemble the ink ribbon cartridge having parts constructed as above, firstly the drive side shaft portions 5, 6 of both the spools 2, 4 of the ink ribbon unit 1 are pivotally received by the bearing apertures 46, 47 of the lower shell 40 respectively, and then the driven side shaft portions 7, 8 are pivotally received by the driven side shaft bearing portions 48, 49 respectively to thereby house both the spool shafts 2, 4 in the spool shaft receiving units 42, 43.

Thereafter, the upper shell 41 is united with the lower shell 40, and then the contacting portion of the ribs 51, 53 of the both shells 40, 41 is melt-fixed by a spot welding 54 or the like, whereby the ink ribbon cartridge is constructed as shown in FIG. 2.

Accordingly, a part of the ink ribbon 3 which traverses from the ribbon supply spool shaft 2 to the ribbon winding-side shaft 4 is exposed from the opening portions 50, 52 of both the shells 40, 41. Further, the ribbon code reading ring 9 is made to be exposed outside partially from recesses 40*a*, 41*a* formed respectively in both the shells 40, 41.

By the way, when the above mentioned conventional ink ribbon cartridge is loaded on a printer apparatus and used for printing action. When the ink ribbon is used up once, the ink ribbon cartridge can not be reused, resulting in being discarded. There is no damages whatsoever, however, to functions of the lower shell 40 and the upper shell 41 which constructs the housing of the cartridge. Therefore, it is possible to reuse the cartridge if the ink ribbon unit is taken out from the inside of the shells, but in view of a product state of the cartridge it is difficult to separate both the shells 40, 41 because they are melt-fixed. Even if they are separated, damages are done to the shell itself, so in the past there has been no other way but to dump all the ink ribbon cartridge, which is not economical.

Further, at a time of dumping the ink ribbon cartridge, sorting out the used ink ribbon, the shells and the spool shafts has to be done after disassembling the given cartridge, so the sorting-out work therefor is troublesome. At the same time, when burning, the shells an incinerating furnace is necessary capable of enduring a high temperature, which has demanded much trouble with the dumping process.

On the other hand, an ink ribbon cartridge with a replaceable ink ribbon unit relative to a housing of the cartridge has been on the market, but the exchange of the ink ribbon unit requires much time in the replacing work and hence in some cases, quality of the ink ribbon may be impaired.

SUMMARY OF THE INVENTION

In view of such aspects, it is an object of the present invention to make it possible to repeatedly use the shell as the cartridge housing, and to provide an ink ribbon cartridge for a printer, in which the ink ribbon unit can easily be loaded by a one-touch operation from the top.

In order to achieve the above mentioned object, an ink ribbon cartridge for a printer according to the present invention has, in the ink ribbon cartridge in which drive side shaft portions and driven side shaft portions of a ribbon supplying spool shaft wound up with an unused ink ribbon and a ribbon take-up spool shaft for winding a used ink ribbon are rotatably received by drive side bearing means and driven side bearing means of a cartridge housing formed of only a lower shell, respectively, drive side bearing means having U-letter shaped drive side bearing portions with shaft disengagement stopping portions in open portions into which the drive side shaft portions are inserted from the top, flange receiving portions for receiving flanges of the drive side shaft portions at the outside of the open portions on the same plane, slits formed with upper portions cut off and between the drive side bearing portions and the flange receiving portions so that the above drive side bearing portions are made to be capable of being elastically deformed toward the slits, the driven side bearing means having in open portions, U-letter shaped driven side bearing portions with shaft disengagement stopping portions into which the driven side shaft portions are inserted from the top, and spool pushing springs disposed at the back of the driven side bearing portions.

With such a construction in place, by dropping the drive side shaft portions and the driven side shaft portions of the spool shafts into the drive side bearing means and the driven side bearing means from the top of the cartridge housing, the drive side shaft portions press open the shaft disengagement stopping portions in the opening portions and are received by the drive side bearing portions. Also, the driven side shaft portions press open the shaft disengagement stopping portions in the opening portions and are rotatably received by the driven side bearing portions and the driven side shaft portions, which are in a state of being rotatably received, are spring-biased toward the drive side shaft portions sides by the spool pushing springs.

The slits are made in length to reach substantially the middle portions of the drive side bearing portions. Therefore, the strength of the drive side bearing portion is not lowered and the elastic deformation force being made possible by which the drive side bearing portions are pressed open can be selected appropriately.

DESCRIPTION OF THE PREFERRED EMBODIMENT

Hereafter, an ink ribbon cartridge for a printer according to an embodiment of the present invention will be described with reference to the accompanying drawings.

Figure 3:
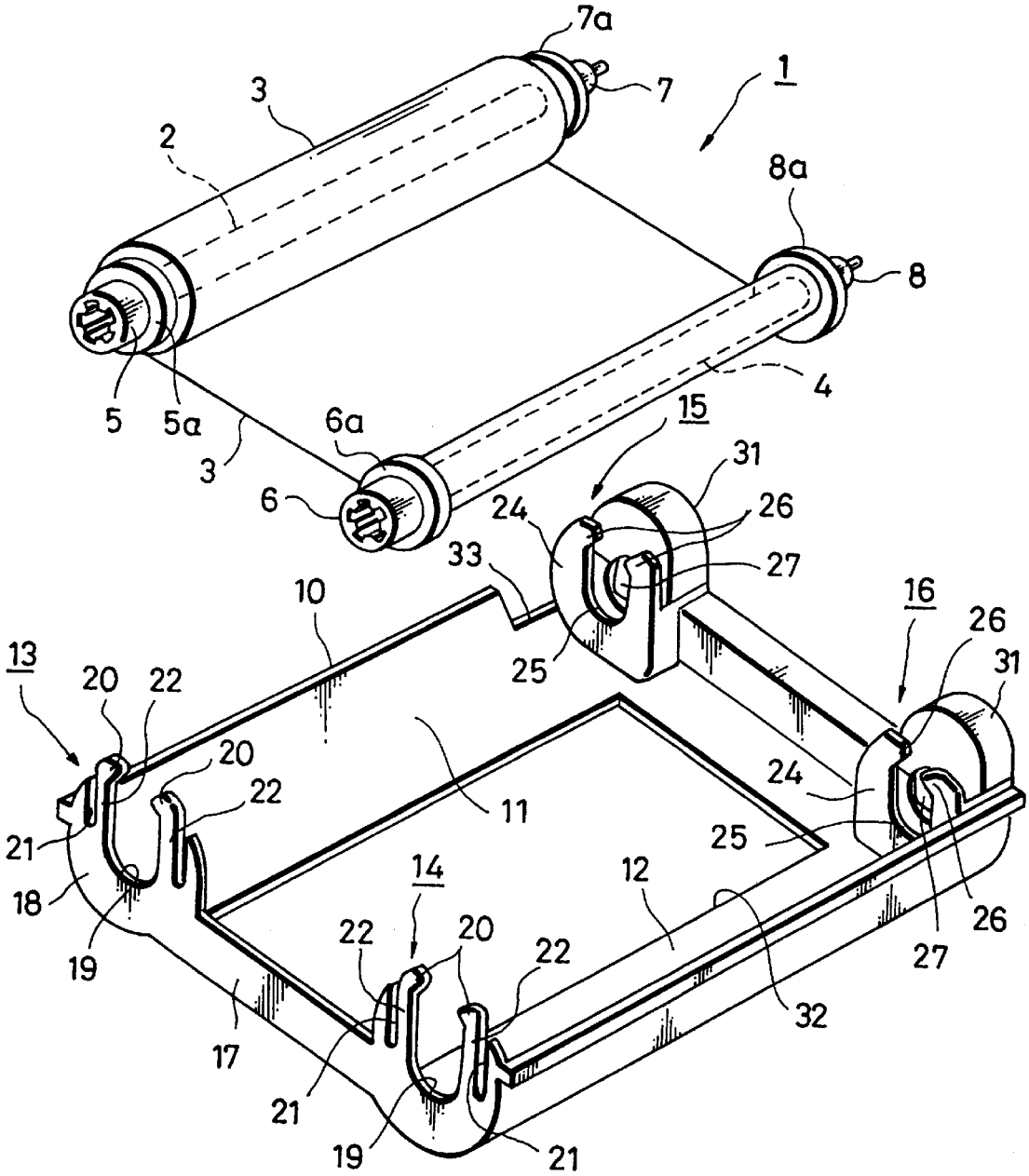
FIG. 3 is a perspective view of an ink ribbon cartridge according to an embodiment of the present invention in a state of being separated into an ink ribbon unit and a cartridge housing.

FIG. 3 is a perspective view showing an ink ribbon cartridge according to the present example in which an ink ribbon unit 1 and a shell constructing a cartridge housing are in a separated state.

Figure 1:
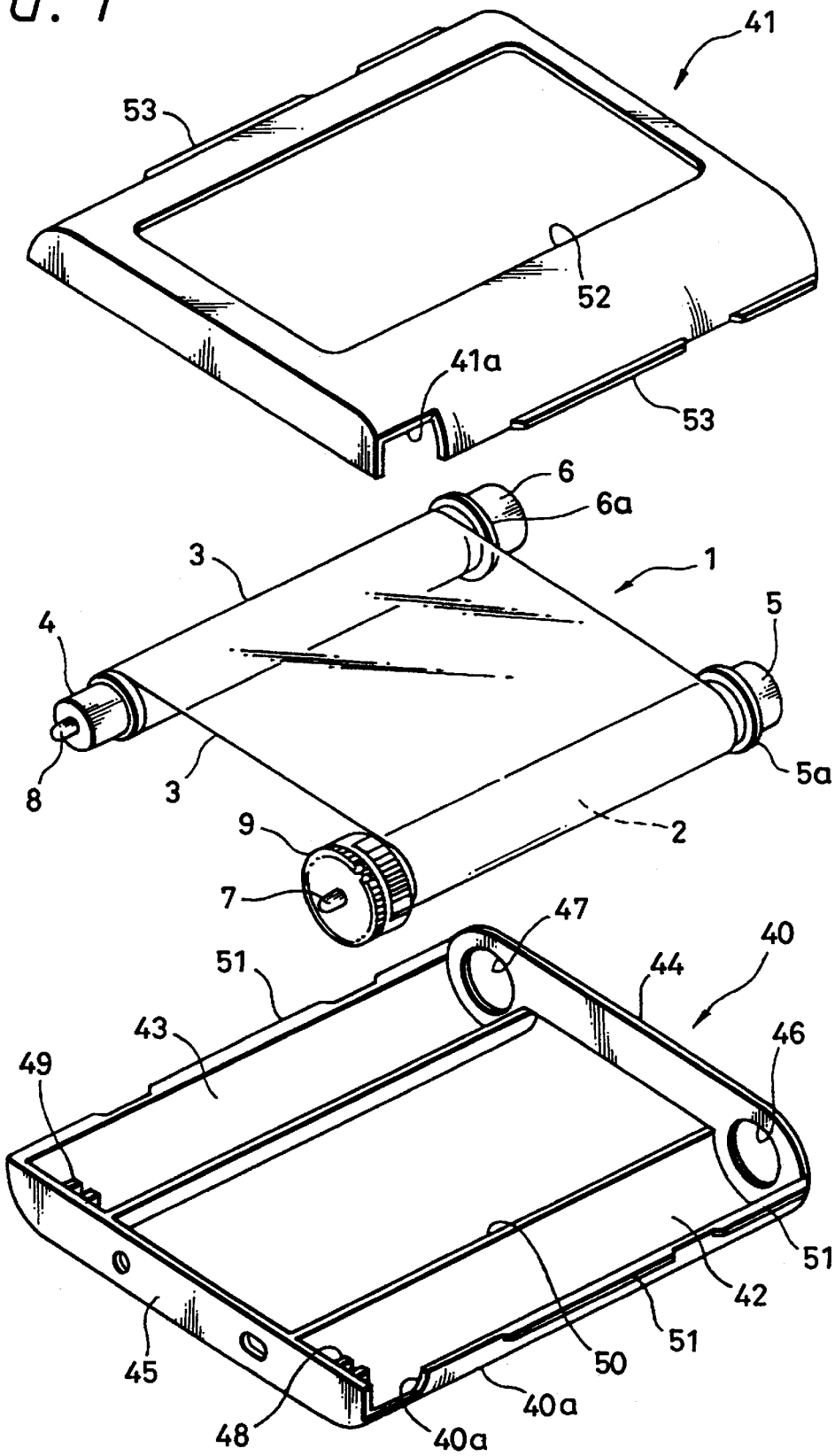
FIG. 1 is a perspective view of a conventional ink ribbon cartridge in a state of being disassembled.
Figure 2:
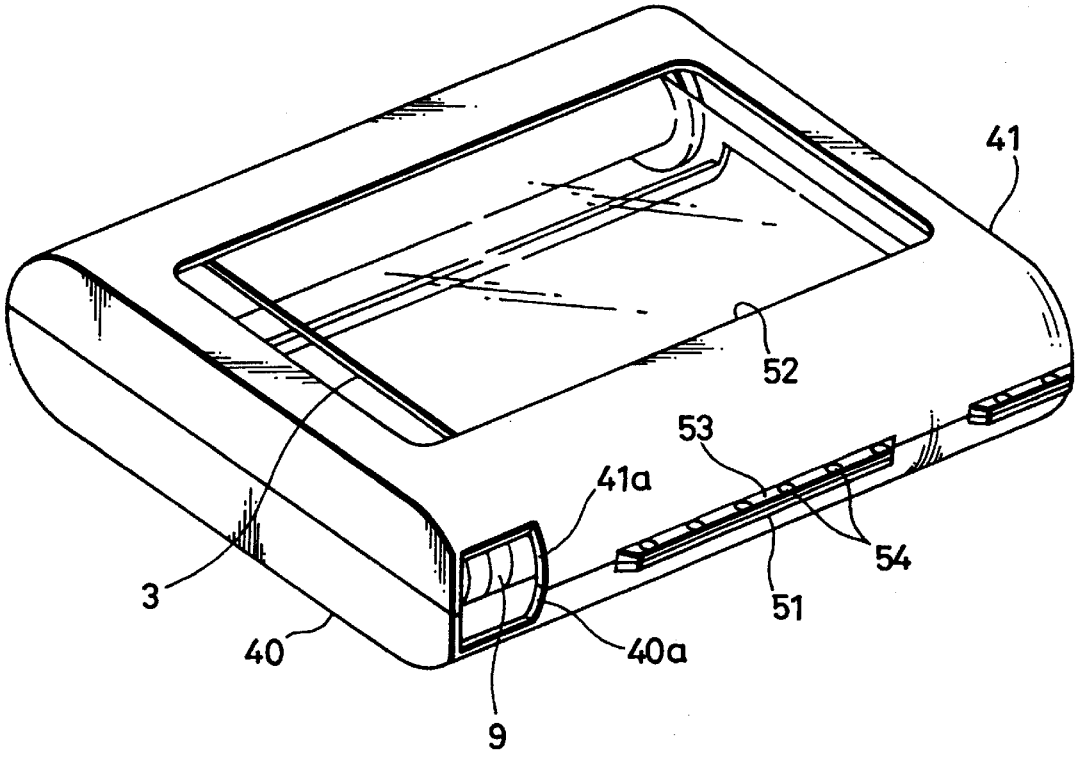
PRIOR ART FIG. 2
FIG. 2 is a perspective view of the conventional ink ribbon cartridge in a state of being assembled.

The ink ribbon unit 1 has a construction same as that of the ink ribbon unit 1 described in FIG. 1 and comprises a ribbon supply spool shaft 2 wound up with an unused ink ribbon 3 and a ribbon takeup spool 4 for winding a used ink ribbon. At one end portions of both the spool shafts 2, 4 are respectively provided hollow drive side shaft portions 5, 6 by way of flanges 5*a*, 6*a* and projections which engage with drive shafts of a printer apparatus are respectively formed on internal circumferential surfaces of the drive side shaft portions 5, 6.

At the other end portions of both the spool shaft 2, 4 are provided driven side shaft portions 7, 8 by way of flanges 7*a*, 8*a*, respectively. A ribbon code reading ring in a portion between the ribbon supply spool 2 and the driven side shaft portion 7 is omitted in the figure.

Next, a construction of the shell of the present invention will be described.

The shell is formed of only a lower shell, for example, molded from, for example, a HIPS (high impact polystyrene) resin. The shell will described hereinafter as a cartridge housing 10.

The cartridge housing 10 has a pair of spool shaft receiving portions 11, 12 at its left and right sides, and at one end portions of both the spool shaft receiving portions 11, 12 are provided drive side bearing means 13, 14 with the other end portions thereof being provided with driven side bearing means 15, 16.

Firstly, the construction of the drive side bearing means 13, 14 will be described.

As the drive side bearing means 13, 14 are same in structure each other, the drive side bearing means 13 on the side of the ribbon supplying spool shaft 5 will be described.

The drive side bearing means 13 has a drive side bearing plate 18 connected with a wall surface plate 17 which is integrally molded from the cartridge housing 10 and on the drive side bearing plate 18 there is formed a U-letter shaped drive side bearing portion 19 having an opening portion into which the drive side shaft portion 5 is inserted from the top. On the open end of the drive side bearing portions 19 there are provided shaft disengagement stopping nails 20, 20.

Figure 4:
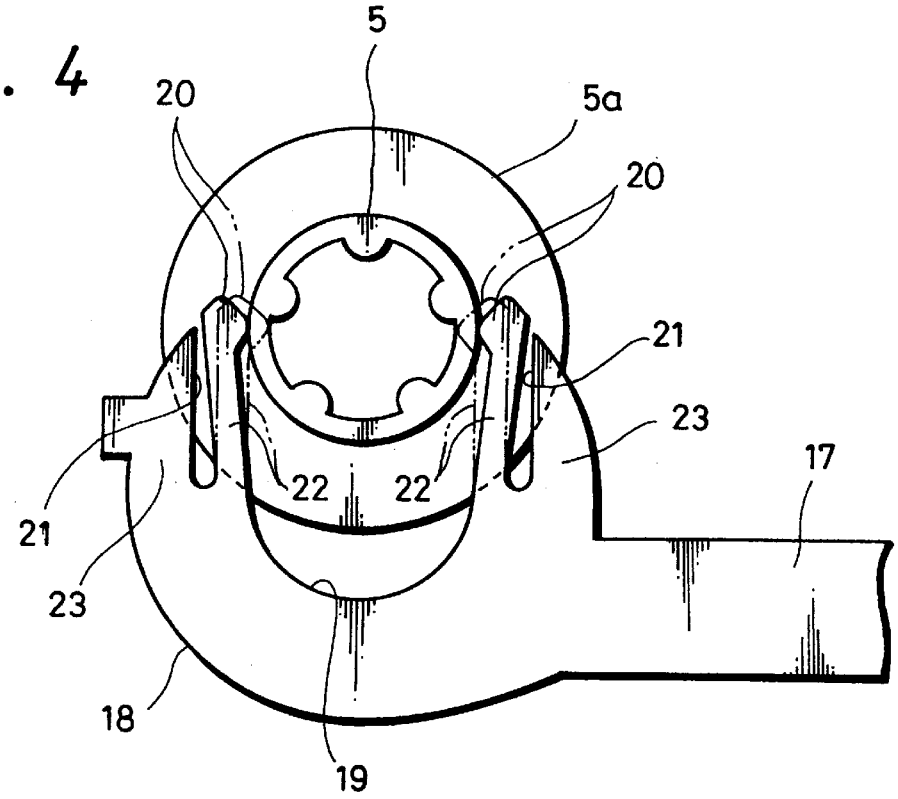
FIG. 4 is a front view showing how the drive side shaft portion is pivotally received.

There are formed in the drive side bearing plate 18 at both left and right side portions of the drive side bearing portion 19, slits 21, 21 by cutting upper portions thereof. Each of the slits has a length reaching substantially the middle portion of the driving side bearing portion 19. Thus, bearing tabs 22, 22 are formed in the drive side bearing portion 19, capable of elastic deformation in directions in which the upper portions of the bearing tabs 22, 22 are is pressed open together with the shaft disengagement stopping nails 20, 20. That is, as FIG. 4 shows, the slit width of each of the slits 21, 21 is set such that the bearing tabs 22, 22 are pressed open to the left and right until the drive side shaft portion 5 inserted from the upper portion of the drive side bearing portion 19 passes through the shaft disengagement stopping nails 20, 20. Also, by making each of the slits 21, 21 have a length reaching to substantially the middle portion of the drive side bearing portions 19, strength of the bearing tabs 22, 22 in surface direction does not lower and moreover, elastic deformation force of the bearing tabs 22, 22 toward the slits 21, 21 can be appropriately set. In addition, a portion of the drive side bearing plate 18 becomes a flange receiving portion 23 for the drive side shaft portion 5 together with outer side portions of the slits 21, 21.

Next, a description will be made about the construction of the driven side bearing means 15, 16. As the driven side bearing means 15, 16 are same in structure, one driven side bearing means 15 on the side of the ribbon supply spool shaft 7 will be described.

The driven side bearing means 15 has a driven side bearing plate 24 which is integrally molded from the cartridge housing 10 and there is formed in the driven side bearing plate 24 a U-letter shaped driven side bearing portion 25 having an opening portion into which the driven side shaft portion 7 is inserted from the top. At the open end of the driven side bearing portion 25 are provided shaft disengagement stopping nails 26, 26. Besides, it may also be advisable that bearing tabs be provided capable of elastic deformation by forming slits with the upper portions cut off at both left and right sides of the driven side bearing portion 25 in the driven side bearing plate 24 like the above mentioned driven side bearing plate 18.

Figure 6:
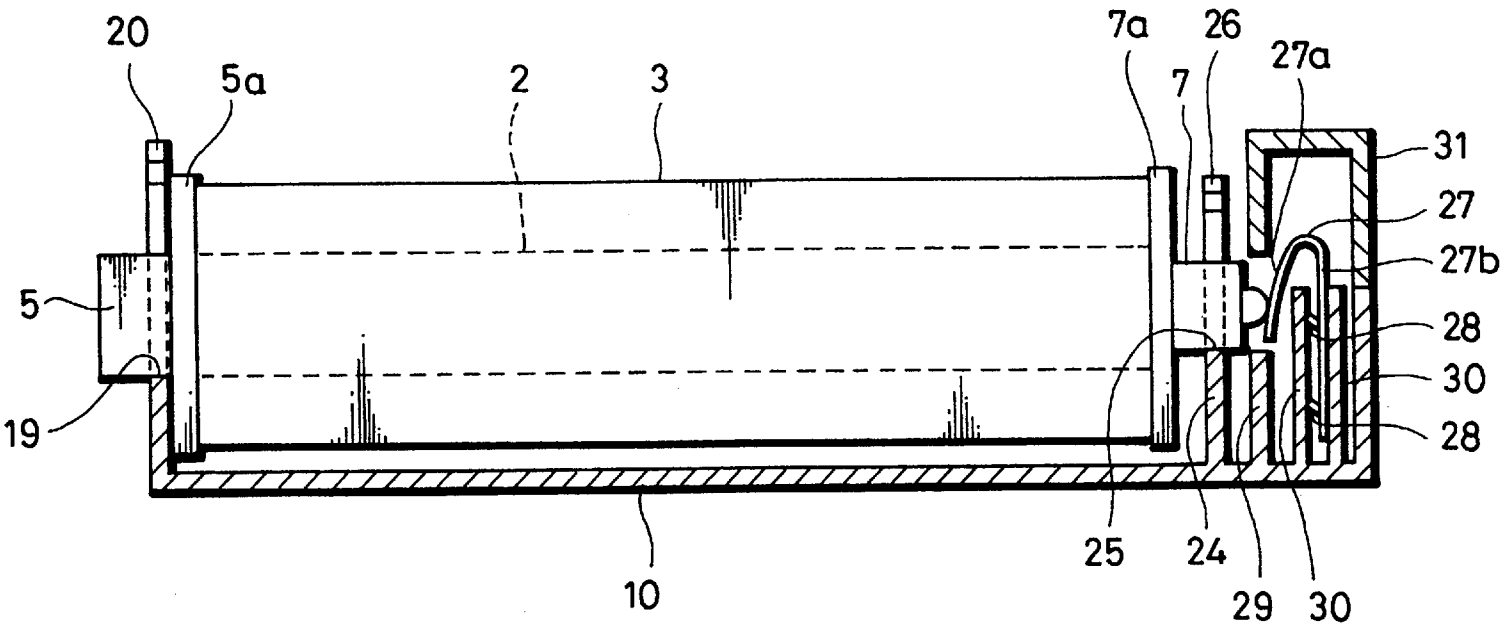
FIG. 6 is a sectional view of the cartridge housing showing a ribbon supply spool shaft being pivotally received.

In the mean time, at the back of the driven side bearing plate 24, as FIG. 6 shows, is fitted a spool pushing spring 27 which is formed by loosely folding a plate into two parts or in an inverse U-letter shape. A supporting means of the spool pushing spring 27 is formed such that notched tabs 28 in an upward direction are formed from one spring tab 27*b* and by forcibly inserting the spring tabs 27*b* between two supporting plates 30, 30 which are projectingly provided from a spring holder 29 at the bottom of the cartridge housing 10, the notched tabs 28 bite into the supporting plate 30, resultantly making it possible for the spool pushing spring 27 to be tightly fixed. The spool pushing spring 27 tightly fixed in such a manner has its other spring tab 27*a* serving as a spool push spring tab. The reference numeral 31 is a holder cover closing the upper part of the spring holder 29.

The cartridge housing 10 has provided with an opening window 32 to which a printing head of the printer apparatus corresponds, and also with a recess 33 to which the ribbon code reading ring, not shown in the figure, of the ink ribbon unit 1 corresponds.

The ink ribbon cartridge for the printer of the present invention is so structured as mentioned above that at a time of loading the ink ribbon unit 1 to the cartridge housing 10 it is positively possible to rotatably receive the spool shafts 3, 4 by an operation of dropping the ink ribbon unit after both the drive side shaft portions 5, 6 of the ribbon supply spool shaft 2 and the ribbon takeup spool shaft 4 respectively correspond to the upper portions of both the drive side bearing means 13, 14 and at the same time, making both the driven side shaft portions 7, 8 respectively correspond to the upper portions of the driven side bearing means 15, 16.

Figure 5:
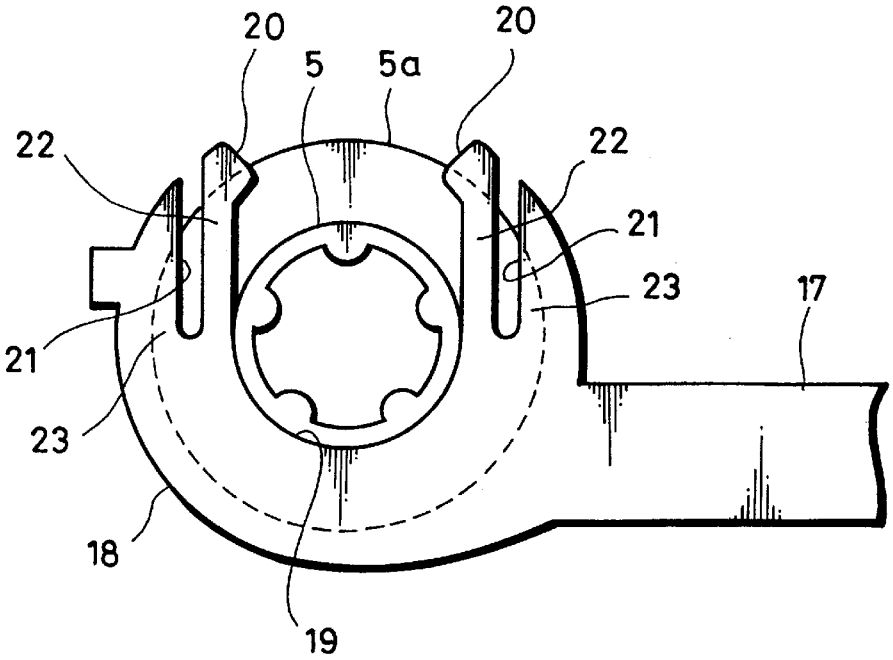
FIG. 5 is a front view of a state that the drive side shaft portion is pivotally received.

The circumstances of how to rotatably receive the spool shafts will be described referring to the ribbon supply spool shaft 2. When the drive side shaft portion 5 is pressed and inserted into the driven side bearing portion 19, the bearing tabs 22, 22 undergo elastic deformation and the shaft disengagement stopping nails 20, 20 are pressed open (see FIG. 4) so that the drive side shaft portion 5 is rotatably received as FIG. 5 shows. Also, when the driven side shaft portion 7 is pressed and inserted into the driven side bearing portion 25, the shaft disengagement stopping nails 26, 26 are pressed open, and then, the driven side shaft portion 7 is rotatably received (refer to FIG. 6). At this time, when the driven side shaft portion 7 is rotatably received, the shaft end of the driven side shaft portion 7 is biased toward the drive side shaft portion 5 side by the spool pushing spring 27 and the flange 5*a* of the drive side shaft portion 5 is pressed to the flange receiving portion 23, with the result of the ribbon supply spool shaft 2 being stopped from rotating. Moreover, even if the cartridge housing 10 is turned over upside down, the drive side shaft portion 5 and the driven side shaft portion 7 are prevented from coming off by the respective shaft disengagement stopping nails 20, 20 and 26, 26.

When the ink ribbon cartridge is loaded to the printer apparatus, the drive side shaft portion 5 is pushed toward the driven side shaft portion 7 while being in a state of engaging with a drive shaft of the printer apparatus. Therefore, the spool pushing spring 27 is more or less pushed back, with the result of the driven side shaft portion 7 being inserted into an opening portion between the spring holder 29 and the holder cover 31 and becoming a state of being pivotally supported. At this time, the drive side shaft portion 5 engaging with the drive shaft of the printer apparatus floats up from the bearing portion and rotates in a state without any contact.

In order to remove a used ink ribbon unit 1 from the cartridge housing 10 of the present invention, if the ink ribbon unit 1 is pulled up, the shaft disengagement stopping nails 20, 20 are pushed and opened in the drive side shaft portion 5 and hence it can come out, while the driven side shaft portion 7 can be removed because the shaft disengagement stopping nails 26, 26 are pushed open.

In this way, since according to the cartridge housing 10 of the present invention, the ink ribbon unit 1 can be freely exchanged, the cartridge itself can be repeatedly used and hence resources are saved. Moreover, as the cartridge housing 10 consists substantially of only the lower shell, when compared with the conventional case of having the upper and lower shells, the using amount of resin can be reduced drastically, thereby capable of being manufactured cheaper by the amount saved.

In the above mentioned embodiment, the description was made on the case in which the spool pushing spring 27 is constructed from a plate spring, but a coiled spring may be used instead of the plate spring. As one example of using the coiled spring, for example, it is preferable to provide at the tip end portion of the coiled spring with a cap-like receiving member so that the receiving member comes in touch with the shaft end of the driven side shaft portion.

When either of the plate spring and the coiled spring is used as the spool pushing spring, if a spool shaft of the ink ribbon is small-sized and light in weight, the plate spring which can be formed to have not so strong spring force is used, while if a spool shaft is comparatively large-sized and heavy in weight, the coiled spring is recommendably used because the coiled spring can obtain strong spring force.

As described before, according to the ink ribbon cartridge for the printer of the present invention, the drive side bearing means have U-letter shaped drive side bearing portions having shaft disengagement stopping portions on opening portions into which the drive side shaft portions are inserted from the top, and flange receiving portions for receiving the flanges of the drive side shaft portions on the same plane at the outside of the drive side bearing portions, and the slits with upper portions cut off are provided between the drive side bearing portions and the flange receiving portions letting the drive side bearing portions be capable of elastic deformation toward the slits. The driven side bearing means form the U-letter shaped driven side bearing portions with opening portions having shaft disengagement stopping portions, into which the driven side shaft portions are inserted from the top and the spool pushing springs are located at the back of the driven side shaft bearing portions. Therefore, when an operation of pushing the drive side shaft portions and the driven side shaft portions of the ink ribbon unit into the drive side bearing portions and the driven side bearing portions from an upper side of the cartridge housing is carried out, the ink ribbon unit can be easily loaded to the cartridge housing in one touch fashion as well as removal of the ink ribbon unit is planned.

Further, as the exchange of the ink ribbon unit can be freely done for the ink ribbon cartridge, the cartridge housing itself can be repeatedly used thereby making it possible to save the resources. Besides, as the cartridge housing is substantially formed of only the lower shell, when compared with the conventional cartridge housing formed of the upper and the lower shells, the used amount of resin can be reduced drastically. As a result, the cartridge housing can be produced cheaper by the amount saved.

Moreover, since the slit are made in length to reach substantially the middle portion of the drive side bearing portions, there is no lowering the strength of the drive side bearing portions and at the same time the elastic deformation force which presses open the drive side bearing portions can be appropriately selected without any concern whether the elastic deformation power is strong or weak.

Having described a preferred embodiment of the present invention with reference to the accompanying drawings, it is to be understood that the present invention is not limited to the above-mentioned embodiment and that various changes and modifications can be effected therein by one skilled in the art without departing from the spirit or scope of the present invention as defined in the appended claims.

What is claimed is:

1. An ink ribbon cartridge for a printer in which drive side shaft portions and driven side portions of a ribbon supplying spool shaft, wound up with an unused ribbon and a ribbon take-up spool shaft for winding a used ribbon, are rotatably received respectively by a drive side bearing means and a driven side bearing means of a housing formed of only a lower shell, characterized in that said drive side bearing means have U-letter shaped drive side bearing portions having shaft disengagement stopping portions at opening portions into which said drive side shaft portions are inserted from the top, flange receiving portions positioned outside of and coplanar with the drive side bearing portions for receiving flanges of said drive side shaft portions, slits formed with upper portions cut off and positioned between said drive side bearing portions and said flange receiving portions making said drive side bearing portions capable of being elastically deformed toward the slits, and wherein said driven side bearing means are respectively formed contiguous with a first and a second driven side spring holder, and form U-letter shaped driven side bearing portions having shaft disengagement stopping portions at opening portions into which said driven side shaft portions are inserted from the top, and first and second spool pushing springs respectively secured to at least one of said first and second driven side spring holders.

2. An ink ribbon cartridge for a printer according to claim 1, wherein said slits have lower portions that extend to substantially a middle portion of each of said drive side bearing portions.

3. An ink ribbon cartridge for a printer according to claim 1, wherein said spool pushing spring is an inverted U-shaped plate.

4. An ink ribbon cartridge for a printer according to claim 1, wherein said driven side spring holders each comprises a first spring supporting plate and a second spring supporting plate, and said spool pushing spring comprises at least one notched tab on a securing portion, said tab applying a friction force against said first supporting plate, and said securing portion applying pressure against said second supporting plate.

5. An ink ribbon cartridge housing formed of only a lower shell, comprising:

a drive side bearing means for a drive side portion of a ribbon supplying spool and a drive side portion of a ribbon take-up spool, which comprises, U-letter shaped drive side bearing portions, and shaft disengagement stopping portions molded to two opening portions of said U-letter shaped drive side bearing means, into which said drive side portions of said ribbon supplying spool and said ribbon take-up spool are inserted from the top; and a driven side bearing means for a driven side portion of a ribbon supplying spool and a driven side portion of a ribbon take-up spool, which comprises:

U-letter shaped driven side bearing portions, and shaft disengagement stopping portion; molded to two opening portions of said U-letter shared driven side bearing means, into which said driven side portions of said ribbon supplying spool and said ribbon take-up spool are inserted from the top;

first and second driven side spring holders, each forming a space with an opening that is covered by said driven side portions of said ribbon supplying spool and said ribbon take-up spool; and first and second spool pushing springs respectively secured to said first and second driven side spring holders within said space.

6. An ink ribbon cartridge housing according to claim 5, further comprising:

slits formed with upper portions cut off and positioned in the vicinity of said drive side bearing portions, and providing ability for said drive side bearing portions to elastically expand toward said slits.

7. An ink ribbon cartridge housing according to claim 6, wherein said slits have lower portions of a length that extends to substantially a middle portion of each of said drive side bearing portions.

8. An ink ribbon cartridge for a printer according to claim 1, wherein said driven side receiving portion comprises a first spring supporting plate and a second spring supporting plate, and said spool pushing spring comprises at least one notched tab on a securing portion, said tab applying a friction force against said first supporting plate, and said securing portion applying pressure against said second supporting plate.

9. An ink ribbon cartridge for a printer according to claim 5, wherein said spool pushing springs are inverted U-shaped plates.

* * * * *